US005537809A

United States Patent [19]

Blalock

[11] Patent Number: 5,537,809

[45] Date of Patent: Jul. 23, 1996

[54] SEED COTTON MODULE HANDLER WITH TRASH SEPARATOR

[75] Inventor: Billy J. Blalock, Albany, Ga.

[73] Assignee: Harrell Company, Inc., Pelham, Ga.

[21] Appl. No.: 388,260

[22] Filed: Feb. 13, 1995

[51] Int. Cl.[6] ..... A01D 61/02; A01D 75/04

[52] U.S. Cl. ..... 56/16.6; 56/477; 56/479; 19/80 R; 19/97.5

[58] Field of Search ..... 56/474, 477, 479, 56/16.6; 15/89; 209/381, 382; 19/80 R, 97.5, 80 A; 460/114

[56] References Cited

U.S. PATENT DOCUMENTS

| | | | |
|---|---|---|---|
| 972,294 | 1/1910 | Tompkins | 19/80 R |
| 2,341,623 | 2/1944 | Kern | 19/85 |
| 3,360,831 | 1/1968 | Morikawa et al. | 19/80 R |
| 3,680,192 | 8/1972 | Stevels | 19/97.5 |
| 4,035,869 | 7/1977 | Wilkes et al. | 19/97.5 |
| 4,344,272 | 8/1982 | Gaudette et al. | 56/16.6 |
| 4,723,344 | 2/1988 | Leifeld | 19/97.5 |
| 5,121,841 | 6/1992 | Harrington et al. | 209/616 |
| 5,222,675 | 6/1993 | Stover | 241/101.1 |

*Primary Examiner*—Randolph A. Reese
*Assistant Examiner*—Heather C. Shackelford
*Attorney, Agent, or Firm*—Hopkins & Thomas

[57] ABSTRACT

An infeed conveyor feeds seed cotton modules successively to a feeder head having disperser drums which reduce the modules to clumps of cotton. Incorporated into the conveyor are fluted rollers and beater rollers which cooperate to agitate the bottom portion of the modules and work the fibers on the bottom of each module so as to stretch and relax these fibers, thereby causing the sand, dirt, mud, trash and other debris accumulated along the bottom of the modules to be released. A conveyor feeds this debris to a hopper.

14 Claims, 4 Drawing Sheets

SEED COTTON MODULE HANDLER WITH TRASH SEPARATOR

FIELD OF INVENTION

This invention relates to a seed cotton module conveyor and is more particularly concerned with an apparatus and process for removing debris, such as dirt, sand, mud, trash and other foreign matter from the bottom portions of seed cotton modules, as the seed cotton modules are fed successively along a prescribed path, such as toward a feeder head, which breaks up the cotton modules into clumps of cotton.

BACKGROUND OF THE INVENTION

The prior art has recognized the fact that, when seed cotton modules are delivered to a gin, they are, at times, stored on the ground or on a slab so that the lower portions of the modules become wet and impregnated with debris, such as dirt, sand, mud, trash and other accumulated particles of foreign matter. It is common for the modules to have been stored out-of-doors on the slabs or on the ground or in fields, prior to the time they are transported to the gin. As a result of such storage, the modules have the debris retained by the fibers along and adjacent to the bottom surface of the module. Such contaminated modules, when fed directly into the feeder head, may damage the cutters of the feeder head and the debris may be passed, with the cotton clumps, along ducts where the sand or other particles abrade the elbows and fan of the duct.

In the past, efforts have been made to slice a bottom portion of the module from the remaining module as or prior to its being disintegrated by the feeder head.

U.S. Pat. No. 5,121,841 issued Jun. 16, 1992 to Harrington, et al., for example, discloses a method and apparatus for separating the more contaminated bottom portion of the feed seed cotton modules from the upper portion. In this patent, a process is described for slicing the bottom portion of the module body away from the remainder of the body, as the main portion of the body is reduced to small clumps of cotton at the feeder head. In this prior art system, the bottom portion, which has been sliced away from the remainder of the module, is fed along a separate path, away from the cotton clumps and the removed cotton is discarded.

U.S. Pat. No. 5,222,675, issued Jun. 29, 1975 to Stover, addresses the problem by providing an arrangement, upstream from the feeder head, which shaves the bottom portion of the module to remove a part of the bottom portion which contains the wet and/or dirty cotton. Both of these prior art apparatuses remove a substantial part of the bottom portion of the cotton module from the upper portion of the module or from the cotton clumps derived from the module. Waste cotton from the Stover process is conveyed away from the remainder of the cotton or cotton clumps of the module.

SUMMARY OF THE INVENTION

Briefly described, the present invention seeks to retain and use substantially all of the seed cotton while separating the dirt, sand, mud, trash and debris from the bottom portion of the module by agitation, beating and a stretching and contraction action along the bottom of each module. The apparatus to achieve this action includes irregularly shaped (non-round) rollers which lift, vibrate, beat and stretch the bottom fibers of the cotton module as they are passed along a path of travel so as to dislodge from this lower portion of the modules, a substantial amount of the sand, soil, dirt, mud and debris previously picked up by the cotton modules. This is accomplished by a plurality of juxtaposed, parallel, non-round, live rollers which convey the module, over an upstream portion of the cleaning bed section, delivering them successively to cylindrical live rollers which feed to the feed header. Most, or all, of these non-round rollers are fluted rollers formed by cylindrical drums provided with an array of equally spaced, outwardly protruding, transversely disposed, circumferentially spaced, beater bars which successively lift, engage and beat the lower surface of the module, as it is fed toward the header. These beater bars are spaced from each other around the periphery of the drums so as to protrude outwardly from the surface of the drum, itself. These beater bars extend in an axial direction with respect to the axis of the roller, across substantially the entire length of each drum. The upper flight of the beater rollers and the live cylindrical infeed rollers define an essentially horizontal bed across which the cotton modules are successively fed.

Interspersed between the live fluted rollers are the live beater rollers which, in cross-section, are preferably square. These beater rollers are usually raised and can be driven at a less peripheral speed than the peripheral speed of the fluted rollers. The beater rollers have flat rectangular plates disposed parallel to the axes of the fluted rollers, each plate being joined along common edges to another similar plate to define a peak at its apex.

Any trash, sand, dirt, soil or debris which is removed from the bottom of the module falls by gravity onto the walls of a funnel shaped trough and are directed onto a cross-conveyor which conveys this dirt sidewise, away from beneath the cleaning bed section of the infeed conveyor.

Accordingly, it is an object of the present invention to provide a simple, yet effective, method and apparatus for removing sand, dirt, trash and debris from the bottom of a seed cotton module as the seed cotton module is being fed along a prescribed path.

Another object of the present invention is to provide an apparatus which will release and automatically remove much of the sand, dirt, trash and debris which has been accumulated on and in the bottom portions of a seed cotton module, prior to the time the module is fed against the disperser drums of the feeder head.

Another object of the present invention is to provide an inexpensive method and apparatus for removing the accumulated sand, dirt, trash and debris on the bottom portions of a seed cotton module without appreciably disturbing the seed cotton in the module.

Other objects, features and advantages of the present invention will become apparent from the following description when considered in conjunction with the accompanying drawings, wherein like characters of reference designate corresponding parts throughout the several views.

DETAILED DESCRIPTION

Figure 1:
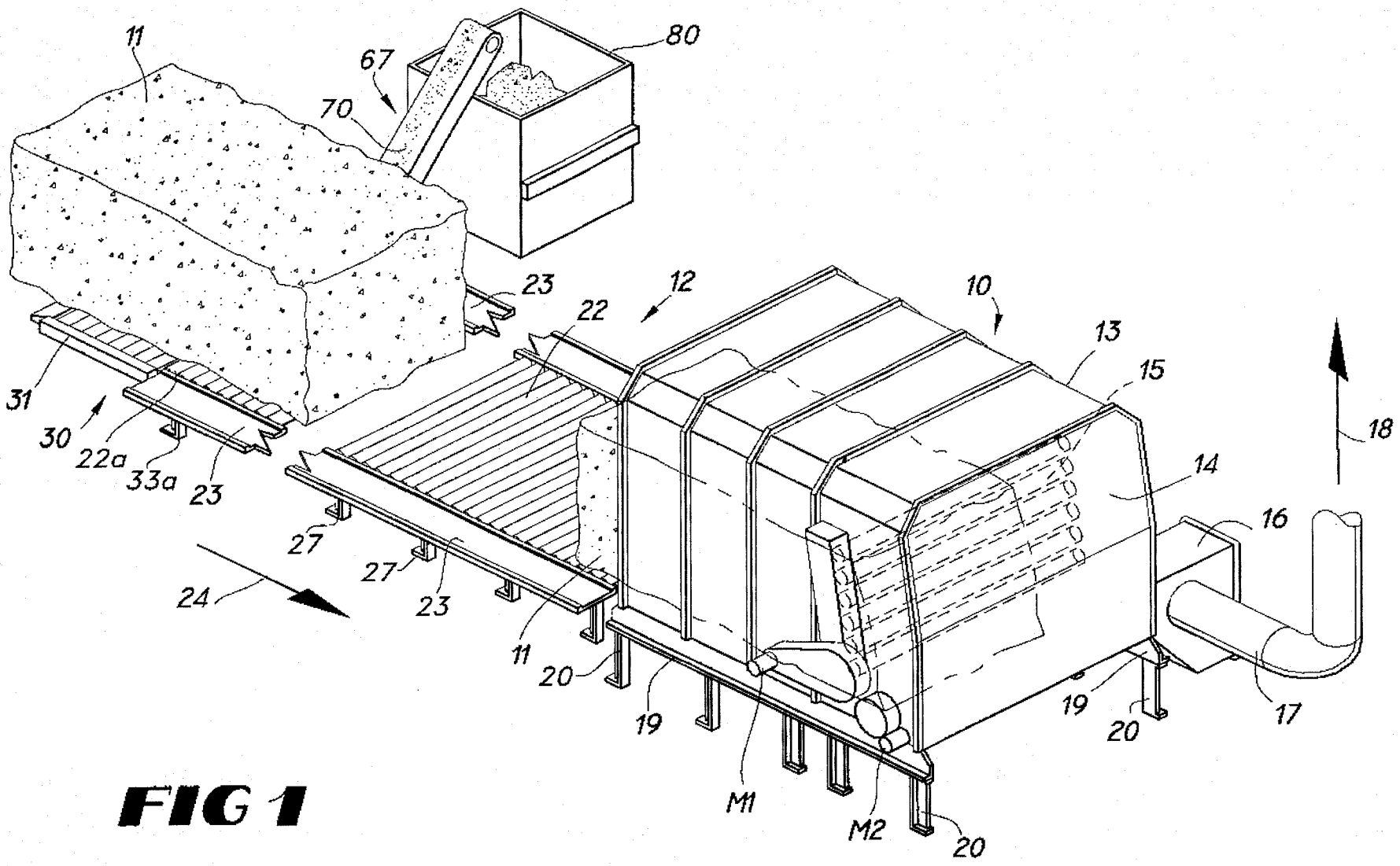
FIG. 1 is a fragmentary perspective view of a portion a seed cotton module handler, having a cleaning bed section of the infeed conveyor constructed in accordance with the present invention, conveying, successive seed cotton modules to a header.

Referring now in detail to the embodiment herein chosen for the purpose of illustrating the preferred embodiment of the present invention, numeral 10 in FIG. 1 denotes generally a feeder head at one end of the cotton module infeed conveyor 12 of a cotton handler. Feeder head 10 includes an inverted U-shaped hood 13, the rear end portion of which is closed by an end plate 14. Within the hood 13 are a plurality of transversely disposed parallel, vertically spaced, disperser drums 15, the axes of which are arranged in an inclined plane so that the uppermost disperser drum 15 will be first to engage the uppermost portion of the incoming seed cotton module 11 and the other lower disperser drums 15, thereafter progressively engage successive lower portions of the module 11, as the module 11 is fed into the feeder head 10. A motor M1 drives all of the disperser drums 15 while a motor M2 drives a cross feed worm conveyor (not shown) for delivering the clumps of cotton (not shown) removed from the cotton module 11 by the disperser drums 15, into a separator air box or housing 16, the cotton clumps (not shown) then being, thence, delivered through a duct 17 to the cotton gin (not shown) these clumps traveling in the direction of arrow 18. In the separator air box 16, any loose sand, dirt, trash, mud or debris from the cotton clumps will separate by gravity from these clumps. The hood 13 is supported in its inverted position by means of a pair of spaced parallel beams 19 which, in turn, are supported on upright legs 20.

The infeed conveyor 12 is essentially conventional and includes a horizontal, rectangular, conveyor frame 26 supported by legs 27 and having a plurality of infeed rollers 22, **22*a* the axes of which are disposed transversely in side-by-side spaced relationship, so as to provide horizontal, upper conveying surfaces formed by the upper peripheries of the rollers 22, 22*a*. Roller 22*a* is the first roller in the group of rollers 22. These rollers 22, 22*a* are live rollers, in that they are simultaneously rotated by a motor (not shown) at uniform speeds so that the modules 11, carried on the upper peripheries of the rotating rollers 22, are urged from the upstream end of the conveyor 12 at roller 22*a* toward and into the feeder head 10 and against drums 15 at the discharge end of conveyor 12**.

Figure 2:
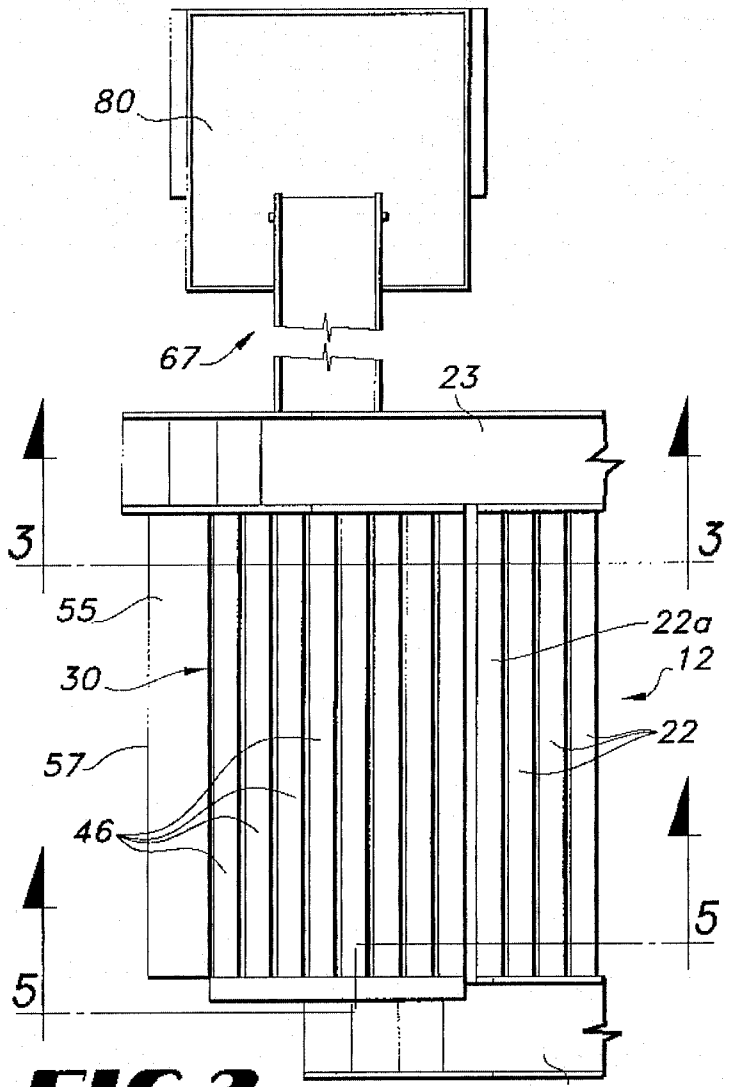
FIG. 2 is a plan view of the cleaning bed section in an entrance end portion of the infeed conveyor of the seed cotton module handler depicted in FIG. 1 and showing sidewalks along the sides of the infeed conveyor.
Figure 6:
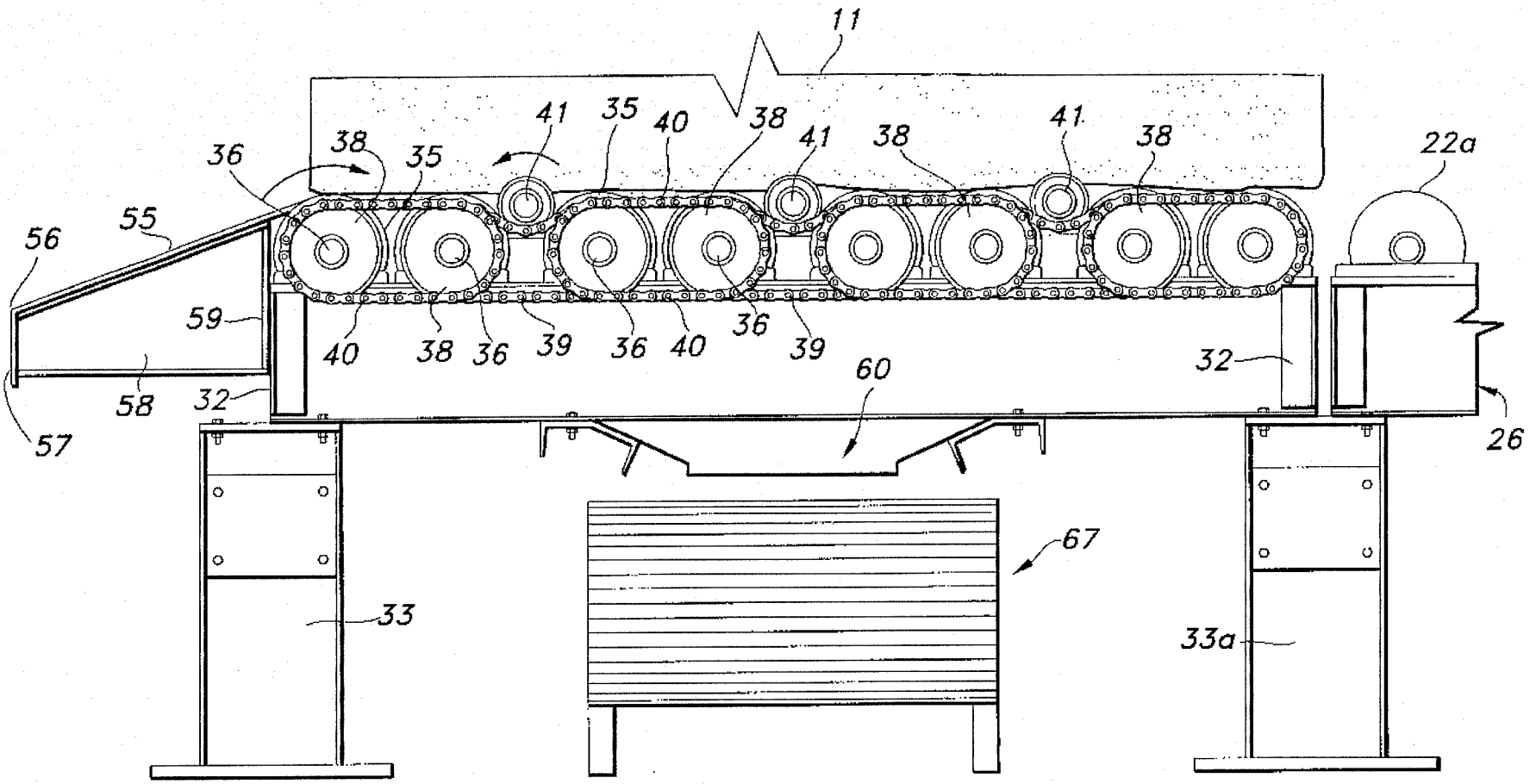
FIG. 6 is a view similar to FIG. 5 and showing the drive of the beater rollers for rotating them in an opposite direction from the other rollers in FIG. 5.

Walkways 23, seen in FIGS. 1 and 2, are provided on the sides of the infeed conveyor frame 26, seen in FIG. 6 for permitting access to the modules 11, as they are fed along the rollers 22, **22*a***.

The upper peripheries of the rollers 22, **22*a* are disposed in a common, essentially horizontal, plane to facilitate the feeding of the modules 11 in the direction of the arrow 24, in FIG. 1**. The structure, thus far described, is essentially conventional.

Figure 3:
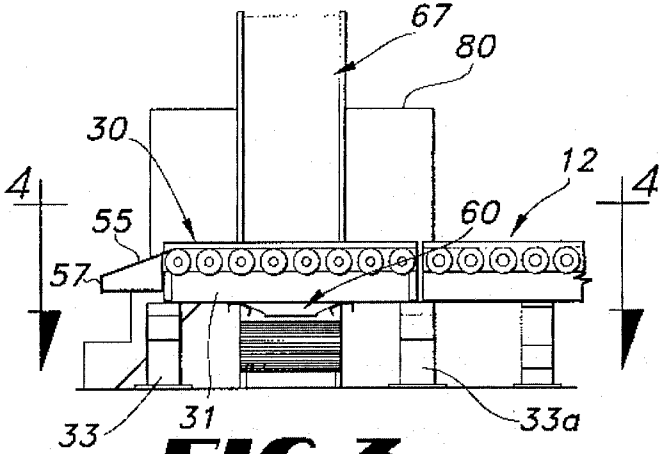
FIG. 3 is a cross-sectional view taken substantially along line 3—3 in FIG. 2.

According to the present invention, a cleaning bed section, denoted generally by numeral 30, is installed in front of roller **22*a* of the infeed conveyor 12 as depicted in FIGS. 1, 2 and 3. This cleaning bed section 30 includes a pair of opposed, parallel, longitudinally extending, support beams, such as beams 31 in FIGS. 3 and 5, the ends of which are joined by cross beams 32 to form a rectangular frame. This rectangular frame is supported at its upstream end by appropriately placed upstanding, upstream stantions 33 and downstream stantions 33*a*, to which the beams 32 are appropriately bolted by bolts 34. The downstream stantions 33*a* also support the upstream or entrance end of the frame 26 adjacent to the first roller 22*a* of the infeed conveyor 12**.

Beams 31 support a plurality of pillar blocks, such as blocks 35, arranged in transversely opposed pairs, so as to support a plurality of spaced, parallel, transversely extending fluted roller shafts 36. The shafts 36 are simultaneously driven at the same speed by means of a plurality of outer and inner sprockets 37 and 38, respectively connected in pairs to the ends of the shafts 36, outwardly of the pillar blocks 35. Preferably the outer sprockets 38 are arranged in transversely aligned, adjacent pairs on shafts 36 so that endless outer chains 40, best seen in FIGS. 4 and 5, encompass longitudinally aligned, adjacent pairs of the outer sprockets 37 while endless inner chains 39 encompass adjacent, longitudinally aligned pairs of inner sprockets 37 so that all of the sprockets 37 and 38 are rotationally driven synchronously. Outer chains 40 are driven by a motor (not shown).

Figures 4, 5:
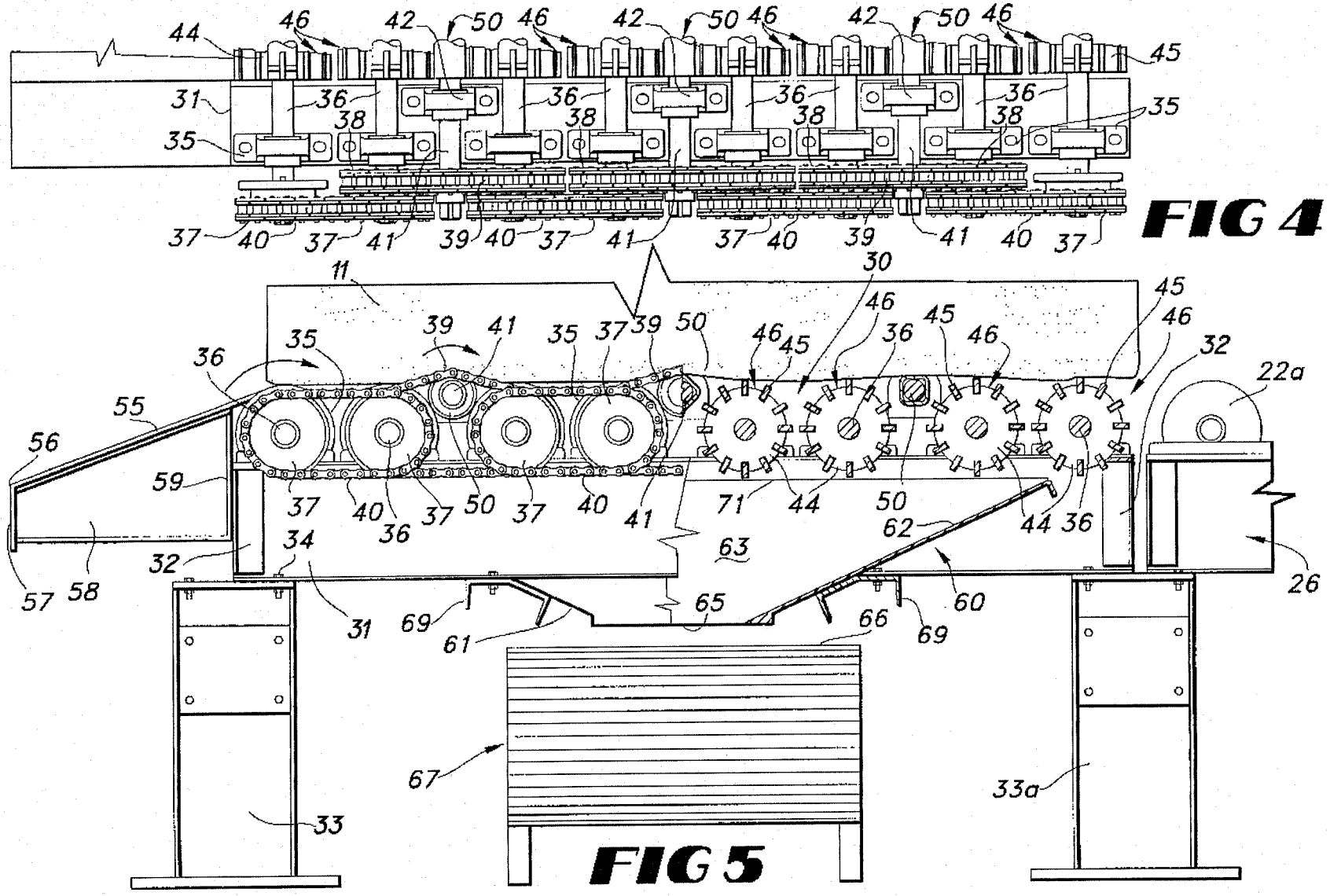
FIG. 4 is a cross-sectional view taken substantially line 4—4 in FIG. 3.
FIG. 5 is a cross-sectional view taken substantially along line 5—5 in FIG. 2 and showing essentially the cleaning bed section of the module handler shown in FIG. 1.

In FIGS. 4 and 5, it is seen that the inner chains 39 also pass over and drive smaller sprockets 42 which are carried by transverse shafts 41 supported by pillar blocks, such as pillar blocks 42, on longitudinal beams 31.

Each of the shafts 36 is provided with a fluted roller 46 which includes a cylindrical drum 44 extending transversely, essentially across the entire width of the cleaning bed section 30, between the pillar blocks 35. The length of drums 44 are thus longer than the width of modules 11. These cylindrical drums 44 are preferably solid pipes or rods which have an outside diameter of approximately 6⅝ inches. Recessed and fixed into circumferentially spaced axial grooves in these drums 44 are a plurality of equally spaced, radially extending, outwardly protruding, rectangular bars, slats or rods 45, each of which protrudes approximately 1½ inches from the periphery of the drum 44. Each such drum 44 is provided with between approximately eight (8) and approximately twelve (12) equally spaced bars 45. These bars 45, if desired, can be cylindrical rods, welded in place on drum 44. A solid periphery for drum 44 is not essential since spaced discs (not shown) can function to support the circumferentially spaced bars 45, if desired. It is believed that the rectangular bars 45, the periphery of which is defined by the outer extremities or edges **45*a* of the bars 45, are preferred. The bars 45 and cylindrical drum 44 form the non-round fluted roller, denoted generally by the numeral 46**.

The spacing of the slats or bars 45 circumferentially along the periphery of the drum 44 is quite significant in that if there are too many slats or bars 45 so that they must be spaced close to one another, the valleys between adjacent slats or bars 45 may fill up with cotton fibers and dirt, sand, debris, etc., sufficiently that the non-round fluted roller 46 will act as a round, continuously cylindrical roller. On the other hand, if there are not enough slats or bars 45, the spacing of bars 45 will be so far apart that the fluted rollers 46 may not adequately work the bottom of the module 11. Hence, there should be a sufficient number of bars 45 (usually 8 to about 12) for the slats or bars 45 to agitate and impart adequate working action on the bottom portion of the modules 11, so as to raise or lower increments of the bottom surface and/or to provide a pulling action on the bottom fibers, as will be explained more fully, hereinafter.

Mounted on each of the shafts 41 is beater roller 50 preferably formed from a rectangular or square tubular hollow rod. As best seen in FIGS. 4, 5 and 6, each beater roller 50 is interposed in a raised position between adjacent fluted rollers 46 so that there are usually two fluted rollers 46, then a raised beater roller 50, followed by two fluted rollers 46, and a second beater roller 50, etc. If desired, these rollers 46, 50 can constitute the entire infeed conveyor 12 or be interposed with the cylindrical rollers 22.

The beater rollers 50 are each formed of a plurality of flat rectangular slats 50*a*, the edges of which are integrally joined to adjacent flat slats 50*a* at angles of 120° or less, so as to provide a plurality of from 3 to about 6 apexes or peaks 50*b* which are straight and parallel to each other and shafts 41 so that peaks 50*b* extend longitudinally throughout the length of the roller 50, the outer surfaces of the apexes or peaks 50*b* being slightly rounded so that they merge into the surfaces of the adjacent pair of slats 50*a*. These slats 50*a* are preferably formed of a 2 inch square tube so as to provide about a ½ inch lift d (FIG. 7) between edge 45*a* and peak 50*b* at the peripheries of rollers 50 and 46, when rotating, such that a transverse bottom increment of the module 11 is engaged by the apex 50*b* at ½ inch above edge 45*a*. The lift d on module 11 between the flat plate 50*a* and the apex 50*b* can be about ¼ inch and about 1 inch. Since the beater rollers 50 are relatively small, being formed of 2 inch square tubes, each roller 50 will usually sag under the weight of a module 11 so that, the ½ inch lift d on module 11 will be only about ¼ inch in the middle portion of module 11. Preferably the beater rollers are 90° out of phase with each other, as shown in FIGS. 5 and 6. Both the fluted rollers 46 and the beater rollers 50 are non-round, having circumferentially spaced, straight transverse portions, such as beaks 50*b* of roller 50 and edges 45*a* of roller 45, which simultaneously engage spaced transverse increments of the bottom of each module 11. These spaced transverse portions 45*a* and 50*c* engage spaced transverse portions of the bottom of modules 11.

Usually the infeed conveyor 12 and hence, the fluted rollers 46 and the beater rollers 50 should provide a conveying width of about 117 inches. Such a width is substantially wider than the width of the modules 11. The distance between the axes of adjacent shafts 36 should be about 7 inches, provided there is no intervening transversely extending shafts 41 of the beater rollers 50. Where there is such an intervening shaft 41, the space between the axes of adjacent shafts 36 should be about 8⅝ inches. Thus, the distance between the axes of an adjacent shaft 36 and shaft 41 should be about 4⁵⁄₁₆ inch.

As best seen in FIGS. 3, 4 and 5, the upstream end of the cleaning bed section 30 is provided with a stationary inclined slide plate 55 leading to the upper working surface of section 30. The forward end of plate 55 is bent at numeral 56 to provide a vertical nose plate 57. This slide 55 is supported by a pair of brackets, such as bracket 58, in FIG. 5. Each bracket 58 has a flange 59 which abuts the front surface of the front cross bar 32 and is fixed thereon so as to support the inclined plate 55, with its rear portion protruding over a portion of the frontmost fluted roller 46 in the cleaning bed section 30. When the modules are delivered in a truck (not shown) from the field or from their storage area, the truck will back in over a portion of the inclined slide plate 55. There are chain conveyors (not shown) within the truck which extend over the plate 55 so that, when the modules 11 are discharged, the modules 11 will be received on the fluted rollers 46 which are disposed adjacent to the slide plate 55.

In operation, modules 11 are initially received at the infeed end or upstream end of the cleaning bed section 30 and are progressively conveyed to the downfeed end of the cleaning bed section 30, being, thence, transferred to the upstream or entrance end of the infeed rollers 20, 20*a* so that each module 11 passes along the infeed conveyor 12 until it is urged by rollers 20 against the disperser drums 15, shown in broken lines in FIG. 1. The fluted rollers 46 and the beater rollers 50 are rotated at a speed such that the modules 11 are advanced toward the head 10 at about 40 to 50 feet per minute.

The shafts 41 are arranged with respect to the shafts 36 so that the maximum diameter of the beater rollers 50 will be a distance of about ½ to 1½ inch above the periphery of the bars 45 of the rollers 46. Furthermore, it is preferred that the beater roller 50 be formed of a ¼ inch thickness steel and be approximately 2 inches in width along each side.

It will be understood that by passing the chain 38 across the top of sprockets 40, it will enable the beater rollers 50 to be rotated in the same direction as fluted rollers 46 but at a lower peripheral speed than the peripheral speed of rotation of the fluted rollers 46. Thus, when the module 11 is resting by its bottom portion on these rollers 46 and 50, as shown, the fluted rollers 46 will act upon the bottom surface of the module 11 so as to tend to beat, agitate, flex, compress and stretch the fibers at the bottom portion of each of the modules 11.

The fibers 68 along the lower portion of each module 11 are in random orientation with respect to each other and capture and hold the particles of debris in the intentice created by these fibers 68. The fluted rollers 46, each have the radially protruding bars 45, the ends 45*a* of which are perpendicular to the opposed parallel side surfaces 45*b* of its bars 45, so as to intersect these surfaces 45*b* respectively at 90°, thereby forming straight, parallel, beveled leading and tracking edges 45*c*. When the module 11 is moved by roller 46, the edges 45*c* dig into the fibers 68 along spaced transverse increments of the bottom of module 11, tending to lift fibers 68 and move them in an arcuate path, forwardly so as to urge the module 11 in a down stream direction along section 30. The lifting and urging of these spaced increments of fibers 68 causes a stretching of the longitudinally oriented fibers, to a greater extent than the transversely oriented fibers and also tends to compact the fibers into the module 11. This results in a shifting of fibers 68 and a readjustment of the intentices which contain the solids, such as the sand, dirt, trash and debris, causing them to migrate and drop by gravity into the grooves or flutes 45*e* between adjacent bars 45, so as ultimately to be transported to the lower flights of the fluted rollers 46 whence the solids drop out of the grooves 45*e*.

Figure 7:
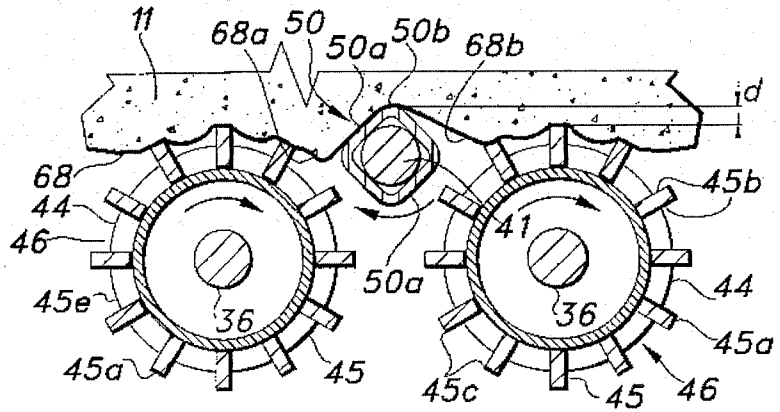
FIG. 7 is an enlarged, schematic, fragmentary, side elevational view of a portion of the cleaning bed section shown in FIG. 2.

These same stretched transverse increments of fibers 68 may then pass to a second fluted roller 46 or to the beater roller 50, as illustrated in FIG. 7. In passing to a second fluted roller 46, the fibers are subjected to a second stretching action, before passing to a beater roller 50.

It will be remembered that the beater rollers have a lower peripheral speed for the peaks 50*b* than the peripheral speed of the outer ends 45*a* and edges 45*c*. Hence, there will be a lag in the travel of stretched fibers 68 so that they form progressive sagging transverse increments of fibers 68*a* in FIG. 7, which are subsequently delivered to the beater roller 50.

In traveling from roller 46 to roller 50, the fibers 68*a* are beat and flexed to permit additional debris to be released from the shifting fibers.

The beater roller 50, as the name implies, applies a beating action on the fibers 68*a* to urge them back onto a compressed condition as successive, compressed, transverse increments of fibers 68*b*.

The flat plates or slats 50*a* have a beating action which successively urges the fibers together while the peaks or apexes 50*b* tends to urge the fibers forwardly. With the lower peripheral speed of roller 50, with respect to the second or downstream roller 46 will have a stretching action on fibers 68*b* so that between roller 50 and downstream roller 46, the transverse increments of fibers, designated fibers 68*b*, are relatively taunt and are again stretched in passing from roller 50 to downstream roller 46. Further stretching is applied to such successive increments by the successive slats 46 of downstream roller 46.

The successive compressions and bending of the fibers 68 causes a progressive change in fiber orientation so as to release the solids.

If it is desired to increase the action of the beater rollers 50, the chains 39 can be passed beneath the sprockets on the shafts 41, as shown in FIG. 6, thereby causing a rotation of the shafts 41 in a direction opposite to the direction of rotation of the shafts 41 in FIG. 5. This rotation of the shafts 41 in an opposite direction increases the beating and stretching of the fibers 68 as they pass over the beater rollers 50.

As best seen in FIGS. 5 and 6, a debris receiving tray 60 is disposed below the rollers 46 and 50 of the cleaning bed section, this tray 60 being formed with downwardly converging flat front plate 61 and back plate 62. The side edges of these generally rectangular plates 62 are joined by trapezoidal shaped side plates 63 so as to provide a wide rectangular mouth 64 extending between substantially all of the rollers 46 and 50, and converging to a discharge opening 65 so as to deliver all of the debris onto the upper flight 66 of a transverse conveyor, denoted generally by the numeral 67. Channel shaped support bars 69 extend between opposed portions of the beams 31 so as to support the trash tray 60 in place, as shown in FIGS. 5 and 6.

The cross conveyor 67 has a continuous belt 68 which moves in a horizontal path beneath the spout or discharge opening 65 of the trough 60 so as to progressively accumulate the debris 70 and transport this debris 70 initially in a horizontal path and then at an incline as depicted in FIG. 1 so as to dump the trash and debris into a receptacle or container 80 disposed along side the cleaner bed section 30.

It will be obvious to those skilled in the art that many variations may be made in the embodiment herein chosen for the purpose of illustrating the present invention, without departing from the scope thereof, as defined by the appended claims.

I claim:

1. A cotton module conveyor for removing sand and dirt from the bottom portions of modules as they are successively fed in a prescribed linear direction along a path of travel toward a feeder head where clumps of cotton are progressively removed from said modules, said modules each having a bottom surface on which the module rests and which may contain debris retained by the fibers of the cotton adjacent to the bottom surfaces of the modules, wherein the improvement comprises:

a non-round rotatable roller having a central axis and a periphery about said axis, said roller being disposed transversely adjacent to said path of travel and over which said modules successively pass in their path of travel so that the upper peripheral portion of said roller contacts said bottom surface of each successive module, the periphery of said roller having circumferentially spaced transverse portions for engaging spaced transverse portions of the bottom surface of each module as said non-round roller rotates, for thereby beating said spaced transverse portions of said bottom surface and loosening said sand and dirt without removing appreciable amounts of the cotton fibers from said modules and so that said sand and dirt fall from said modules during the travel of each module along its path of travel.

2. The cotton module conveyor defined in claim 1 wherein said roller has an axial length greater than the width of said module and said transverse portions extend throughout substantially the entire length of said roller.

3. The cotton module conveyor defined in claim 1 wherein said non-round roller is a first roller, and including a second rotatable roller disposed adjacent to said first roller, said second roller having an axis parallel to the axis of said first roller, said second roller being spaced from said first roller for receiving the bottom surface of said modules on its upper periphery so that said modules pass from one roller to the other and so that said first and said second roller cooperate to tend to stretch the cotton fibers adjacent to and along said bottom surface for imparting a working action to said fibers adjacent to and along said bottom surface sufficient to release said sand and dirt.

4. A cotton module conveyor for removing sand and dirt from the bottom portions of modules as they are successively fed along a path of travel, said modules each having a bottom surface on which the module rests and which may contain debris retained by the fibers of the cotton adjacent to the bottom surfaces of the modules, wherein the improvement comprises:

a rotatable roller having a central axis and a periphery about said axis, said roller being disposed transversely adjacent to said path of travel and over which said modules successively pass in their path of travel so that the upper peripheral portion of said roller receives successive transverse portion of said bottom surface of each successive module, the periphery of said roller having circumferentially spaced transverse portions for engaging spaced transverse portions of the bottom surface of each module as said non-round roller rotates, for thereby loosening said sand and dirt without removing appreciable amounts of the cotton fibers from said modules and so that said sand and dirt fall from said modules during the travel of each module along its path of travel; said transverse portions of said non-round rotatable roller including a plurality of circumferentially spaced bars forming the outer periphery of said roller, said bars being disposed parallel to the axis of said roller.

5. The cotton module conveyor defined in claim 1 wherein said non-round rotatable roller includes a drum and said transverse portions include a plurality of equally spaced, longitudinally disposed, bars protruding from the axis of said drum, the periphery of said drum being concentric with the axis of said roller.

6. A cotton module conveyor for removing sand and dirt from the bottom portions of modules as they are successively fed along a path of travel, said modules each having a bottom surface on which the module rests and which may contain debris retained by the fibers of the cotton adjacent to the bottom surfaces of the modules, wherein the improvement comprises:

a rotatable roller having a central axis and a periphery about said axis, said roller being disposed transversely adjacent to said path of travel and over which said modules successively pass in their path of travel so that the upper peripheral portion of said roller receives successive transverse portion of said bottom surface of each successive module, the periphery of said roller having circumferentially spaced transverse portions for engaging spaced transverse portions of the bottom surface of each module as said non-round roller rotates, for thereby loosening said sand and dirt without removing appreciable amounts of the cotton fibers from said modules and so that said sand and dirt fall from said modules during the travel of each module along its path of travel; said transversely extending portions including adjacent flat plates disposed around said axis of said roller, said plates being along arcs of said roller and being angularly disposed with respect to each other and joined at common edges to provide a plurality of equally spaced straight transverse apexes, the plates being at acute angles to each other so as to impart to said bale a beating action when said roller is rotated.

7. The cotton module conveyor defined in claim 1 wherein said non-round rotatable roller is a first roller and including a second rotatable roller disposed adjacent to said first roller, said second roller having an axis parallel to the axis of said first roller, said second roller being provided with a non-uniform periphery so that said first roller and said second roller cooperate together for imparting a beating and stretch action to fibers in successive portions of the bottom surface of each module as the modules pass first over one of the rollers and then over the other said rollers, and means for rotating both of said rollers, simultaneously.

8. A cotton module conveyor for removing sand and dirt from the bottom portions of modules as they are successively fed along a path of travel, said modules each having a bottom surface on which the module rests and which may contain debris retained by the fibers of the cotton adjacent to the bottom surfaces of the modules, wherein the improvement comprises:

a first rotatable roller having a central axis and a periphery about said axis, said roller being disposed transversely adjacent to said path of travel and over which said modules successively pass in their path of travel so that the upper peripheral portion of said roller receives successive transverse portion of said bottom surface of each successive module, the periphery of said roller having circumferentially spaced transverse portions for engaging spaced transverse portions of the bottom surface of each module as said non-round roller rotates, for thereby loosening said sand and dirt without removing appreciable amounts of the cotton fibers from said modules and so that said sand and dirt fall from said modules during the travel of each module along its path of travel;

a second rotatable roller disposed adjacent said first roller, said second roller having an axis parallel to said axis of said first roller and having a non-uniform periphery so that said first and second rollers cooperate for imparting a beating and stretch action to fibers in successive portions of the bottom surface of each module as the modules pass over each of said rollers; and means for rotating said rollers with said first roller being rotated at a different speed of rotation than said second roller and wherein said transverse portions of said first roller have flat surfaces circumferentially spaced from each other and joined along common edges, said flat surfaces being disposed angularly with respect to other of said rollers, such that the flat surfaces act to beat the bottom portion of said modules when said modules pass thereover.

9. A cotton module conveyor for removing sand and dirt from the bottom portions of modules as they are successively fed along a path of travel, said modules each having a bottom surface on which the module rests and which may contain debris retained by the fibers of the cotton adjacent to the bottom surfaces of the modules, wherein the improvement comprises:

a first rotatable roller having a central axis and a periphery about said axis, said roller being disposed transversely adjacent to said path of travel and over which said modules successively pass in their path of travel so that the upper peripheral portion of said roller receives successive transverse portion of said bottom surface of each successive module, the periphery of said roller having circumferentially spaced transverse portions for engaging spaced transverse portions of the bottom surface of each module as said non-round roller rotates, for thereby and loosening said sand and dirt without removing appreciable amounts of the cotton fibers from said modules and so that said sand and dirt fall from said modules during the travel of each module along its path of travel;

a second rotatable roller disposed adjacent said first roller, said second roller having an axis parallel to said axis of said first roller and having a non-uniform periphery so that said first and second rollers cooperate for imparting a beating and stretch action to fibers in successive portions of the bottom surface of each module as the modules pass over the rollers, and with said second roller being provided with a plurality of radially extending rectangular rods circumferentially, equally spaced from each other for engaging the bottom surfaces of the modules which are fed successfully thereover, the adjacent of said bars being spaced apart sufficiently so that the cotton will not fill in the space between said bars to reduce the effectiveness of said bars in engaging in the bottom surfaces of said modules; and means for rotating said rollers.

10. The cotton module conveyor defined in claim 7 including a plurality of cylindrical rollers having axes parallel to said axis of said non-round roller for forming an infeed conveyor for said modules, said first and second rollers being disposed adjacent to at least certain of said cylindrical rollers and a feeder head having disperser drums disposed at the downfeed end of said conveyor for contacting said modules to progressively remove clumps of cotton from said modules.

11. The cotton module conveyor defined in claim 1 including an infeed conveyor having rollers disposed parallel to said non-round roller and disperser drums across the path of said modules for receiving said modules successively thereagainst and for reducing said modules into clumps of cotton.

12. The cotton module conveyor defined in claim 1 including means for rotating said non-round roller and including an infeed conveyor having rotating cylindrical rollers for feeding said cotton modules along a prescribed path, said non-circular roller being disposed parallel to and adjacent to at least one of said rollers of said infeed conveyor, said non-round roller cooperating with the rollers of said infeed conveyor for beating the lower surface of each of said cotton modules as they are fed along their path of travel.

13. The cotton module conveyor defined in claim 1 wherein said roller has a plurality of flat plates arranged angularly with respect to each other, said flat plates joining each other to form at least three apexes along common edges, said apexes being straight and parallel to the axis of said non-round roller and a plurality of said second rollers on both sides of said non-round roller, said non-round roller being raised above the other rollers for imparting a beating action to the bottom surfaces of said modules as each of said modules pass thereover.

14. The cotton module conveyor defined in claim 1 wherein said non-round roller is a first roller, and including a pair of second rollers having peripheries and disposed on opposite sides of said first roller, said first roller being raised sufficient that the effective periphery of said first roller is above the peripheries of said second rollers.

* * * * *